United States Patent [19]

Friedman

[11] Patent Number: 4,974,130

[45] Date of Patent: Nov. 27, 1990

[54] MINIATURE PORTABLE LIGHT

[76] Inventor: Arthur S. Friedman, Box 625, 2144 Soneca West, Merrick, N.Y. 11566

[21] Appl. No.: 539,216

[22] Filed: Jun. 18, 1990

[51] Int. Cl.[5] ..... F21L 11/00

[52] U.S. Cl. ..... 362/199; 362/108; 362/191; 362/200; 362/394

[58] Field of Search ..... 362/108, 190, 191, 197, 362/199, 200, 295, 394, 802

[56] References Cited

U.S. PATENT DOCUMENTS

| | | | |
|---|---|---|---|
| 1,247,346 | 11/1917 | Stern . | |
| 1,820,960 | 9/1931 | Champagne et al. . | |
| 1,950,103 | 3/1934 | Embury | 362/199 |
| 1,984,398 | 12/1934 | Dame . | |
| 3,479,499 | 11/1969 | Dahl . | |
| 4,432,042 | 2/1984 | Zeller | 362/183 |
| 4,459,646 | 7/1984 | Drane | 362/199 |
| 4,631,644 | 12/1986 | Dannhauer | 362/105 |
| 4,893,221 | 1/1990 | Friedman | 362/108 |

FOREIGN PATENT DOCUMENTS 1011412 12/1965 United Kingdom .

OTHER PUBLICATIONS

Radio Shack 1990 Catalog, No. 446, p. 153.

*Primary Examiner*—Stephen F. Husar

*Attorney, Agent, or Firm*—Dennison, Meserole, Pollack & Scheiner

[57] ABSTRACT

A portable light including a flat battery case with a lamp housing pivotally joined thereto for movement between a first position in parallel overlying relation to the battery case and within the peripheral confines thereof and a second fully opened position projecting outwardly from said battery case generally parallel thereto.

10 Claims, 2 Drawing Sheets

FIG. 1.
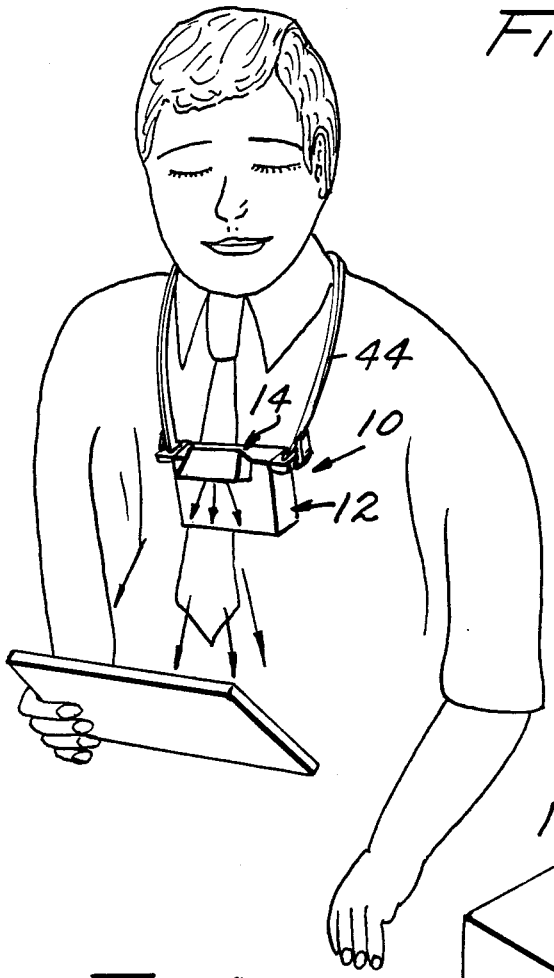
FIG. 2.
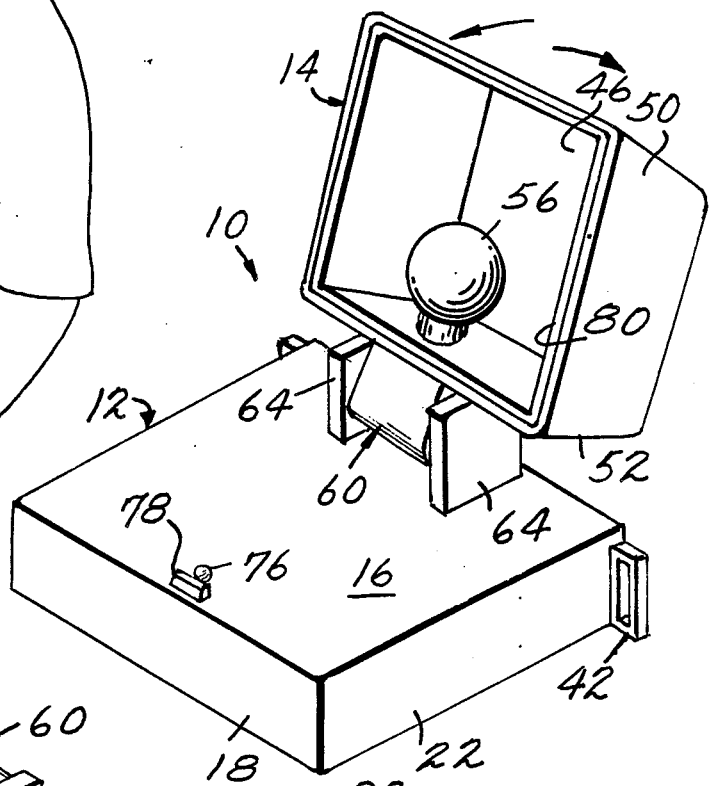
FIG. 3.
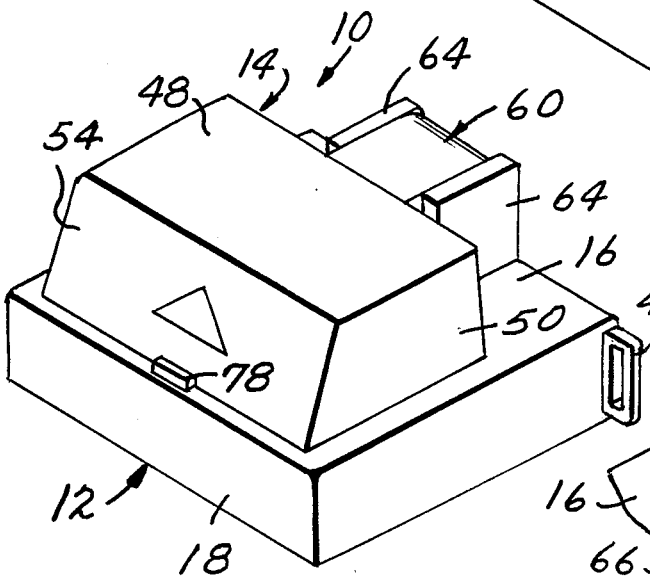
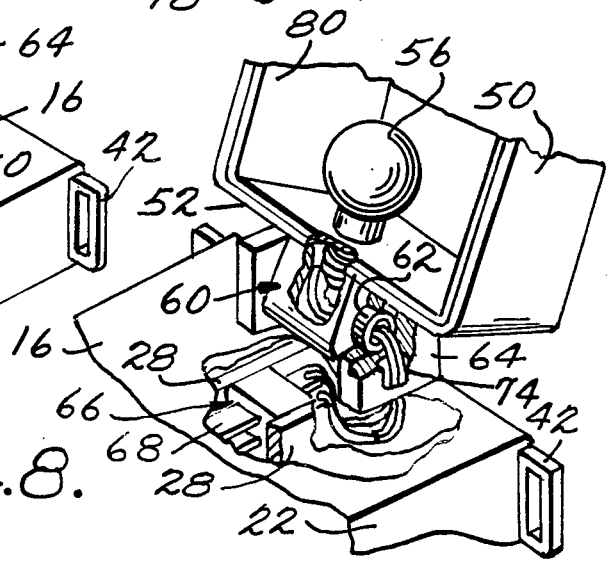
FIG. 8.

MINIATURE PORTABLE LIGHT

BACKGROUND OF THE INVENTION

The invention relates to portable lights of the general type disclosed in applicant's U.S. Pat. No. 4,893,221, issued Jan. 9, 1990.

The principal purpose of such portable lights is to provide a readily available source of illumination for a variety of tasks and under a variety of conditions. The practicality of such a light is a direct function of the ease with which the light can be carried on one's person, for example in a pocket or in a purse, or suspended about the neck.

In addition to portability, the light must provide a substantial degree of useful illumination and be convenient to both hold and manipulate for use under a range of conditions varying from general area illumination to concentrated illumination for reading, map studying and the like.

SUMMARY OF THE INVENTION

The goals of the present invention are similar to those of applicant's prior patent, with the new portable light herein defined including a uniquely compact construction providing maximum miniaturization without affecting illumination. The light of the invention also incorporates enhanced adjustability wherein the lamp housing itself is moveable or adjustable relative to the mounting base, defined by the battery case, through an arc of 180 degrees, whether mounted on a flat support surface, suspended about the neck of a user, or hand held.

The miniature portable light of the invention includes a battery case in the nature of a flat pack accommodating and closely conforming to four small AAA batteries with a single narrow central channel mounting a pressure switch.

The lamp housing is also of a thin profile defining a forwardly directed reflector-lined bulb compartment. The lamp housing is pivotally mounted to the flat upper face panel of the battery case centrally adjacent one edge thereof for pivotal movement through an arc of approximately 180 degrees between a closed position wherein the open face of the lamp housing closes against the upper face panel of the battery case and is fully within the peripheral confines of this upper face panel, and a second fully opened position wherein the lamp housing extends from the battery case generally parallel to and outward of the face panel. A pressure switch, responsive to movement of the lamp housing away from the closed position thereof, illuminates the lamp throughout the full range of movement of the lamp housing. The lamp housing is selectively positionable between the extreme positions thereof.

The battery case includes a flat back panel which can be placed on a support surface. In addition, the battery case is provided with a pair of apertured projections or ears which are adapted to selectively receive an appropriate neck strap for suspension of the portable light from the neck of a user for hands-free reading and the like.

The lamp housing is of a size to dimensionally fit within the peripheral confines of the battery case when the lamp housing is in the closed position thereof. In this manner, maximum compacting of the portable light for storage purposes is achieved. The bulb itself, with the open face of the lamp housing closed against the face panel of the battery case, is fully protected against accidental damage by the full bulk of the battery case.

Other features and advantages of the invention will become more apparent from the following detailed description of the invention.

BRIEF DESCRIPTION OF THE DRAWINGS

FIG. 1 illustrates the portable light mounted about the neck of a user for use as a reading light;

FIG. 2 is a top perspective view of the portable light in an open position thereof;

FIG. 3 is a top perspective view of the portable light in the closed position thereof;

FIG. 8 is a perspective detail, with portions broken away, illustrating the mounting of the lamp housing and the routing of the lamp circuit wires.

DESCRIPTION OF PREFERRED EMBODIMENT

Figure 5:
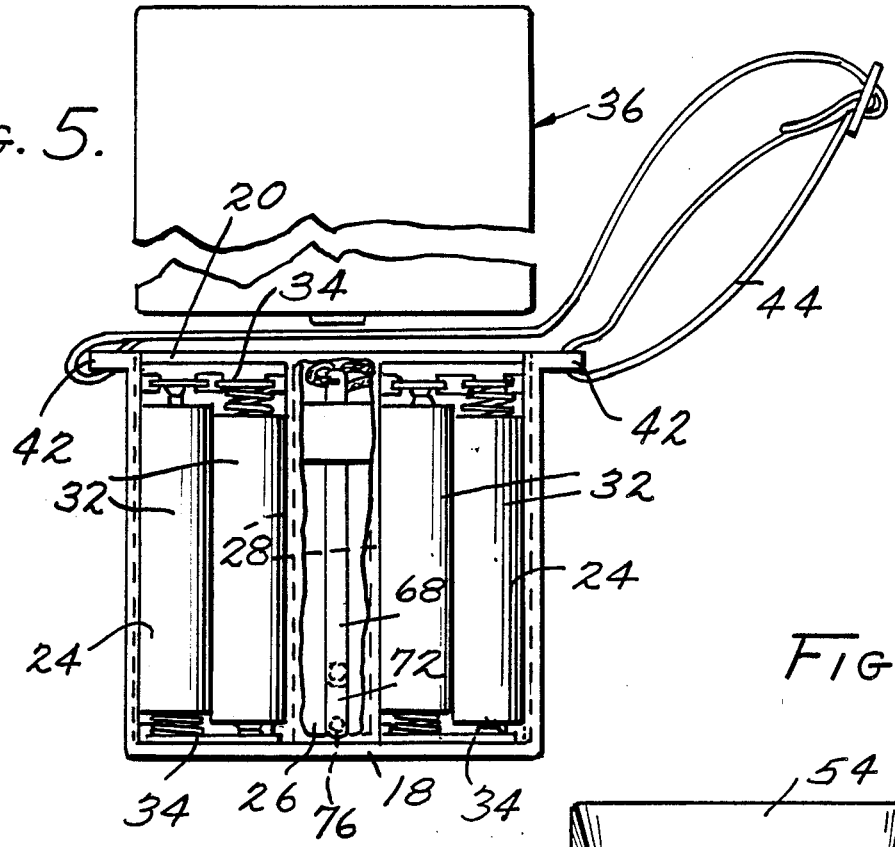
FIG. 5 is a bottom plan view of the battery case with the bottom closure panel removed.

Referring now more specifically to the drawings, the portable light 10 of the invention basically comprises a flat rectangular battery case 12 and a generally rectangular lamp housing 14 pivotally mounted to the battery case 12.

The battery case 12 includes a flat top or upper face panel 16 with integral depending peripheral walls comprising front and rear walls 18 and 20 and opposed side walls 22. The face panel 16 and peripheral walls define a downwardly opening compartment divided into a pair of laterally spaced battery chambers 24 by a narrow central switch chamber or channel 26 defined by closely spaced parallel walls 28 extending between the front and rear peripheral walls 18 and 20. The switch chamber, as desired, can be sealed by a bottom panel 30 extending between the chamber walls 28. The two defined battery chambers 24 are each of a size to closely accommodate a pair of adjacent AAA batteries 32 with appropriate contact means 34 at the opposite ends thereof. Thus configured, the battery case 12 is compact and only minimally larger than four AAA batteries.

Figure 4:
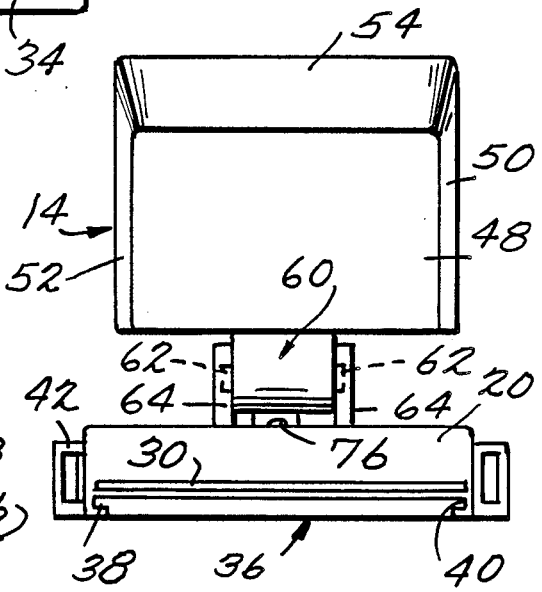
FIG. 4 is a rear elevational view of the portable light in an open position thereof.
Figure 6:
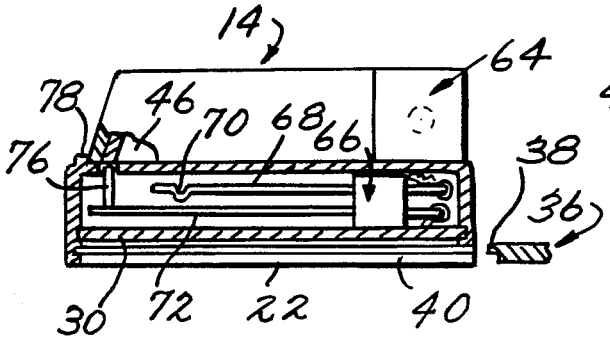
FIG. 6 is a longitudinal view of the closed portable light with the battery case shown in cross-section illustrating the central switch channel with the switch in its open position.

The compartment is closed by a removable planar lower or back panel 36. Noting FIGS. 4 and 6, the back panel 36 includes a pair of lateral extensions 38 along the opposed side edges thereof which are slidably received within grooves 40 on the inner faces of the opposed battery case side walls 22. The rear wall 20 of the battery case includes a cut-out portion therein complementary to the back panel 36 for slidable introduction and removal of the back panel therethrough in an obvious manner.

The battery case is completed by a pair of apertured mounting ears 42 extending laterally outward from the opposed side walls 22 coplanar with the rear wall 20 and comprising means for mounting a neck strap 44 for suspension of the miniature portable light 10 about the neck of a user as suggested in FIG. 1. So mounted, the miniature portable light can be used for reading, close work, general area illumination and the like.

The lamp housing 14 is of a thickness slightly greater than that of the battery case 12 and includes an enlarged forwardly opening bulb compartment 46 defined by a planar top panel 48, laterally opposed vertical side panels 50, a vertical rear panel 52, and an outwardly inclined front panel 54. The outer edges of the side, rear and front panels form a continuous free peripheral edge about the open face of the bulb compartment 46.

The bulb 56 screw mounts into an appropriate socket 58 integrally formed with and through the rear bulb compartment panel 52. A hollow extension 60 is integrally formed with the rear panel 52 centrally thereof and in alignment with the bulb socket 58. The extension 60 is of equal height with the lamp housing 14 and includes a pair of oppositely directed mounting lugs 62, at least one of which is hollow.

The lamp housing extension 60 is received between a pair of laterally spaced flat mounting posts 64 centrally fixed to the top or face panel 16 immediately adjacent the rear wall 20. The planar inner surfaces of the mounting posts the mounting lugs 62 for a pivotal mounting of the lamp housing 14. It is contemplated that the construction of the mounting components be such as to enable a snap-locking of the extension 60 into position between the opposed mounting posts 64. When mounted, the lamp housing is pivotal between two extreme positions, a closed position overlying and paralleling the face panel 16 with the open face of the lamp housing, and more particularly, the peripheral edge thereof, engaged with the face panel 16, and a fully open position wherein the lamp housing 14 is rotated through 180 degrees and projects rearwardly of the rear panel 20 of the battery case parallel to the battery case. The lamp housing 14, in the closed position thereof, as illustrated in FIG. 3, is, with the extension 60 thereon, of a length and width slightly less than that of the battery case face panel 16 to fall within the peripheral confines thereof and provide a compact and miniaturized portable lamp.

Figure 7:
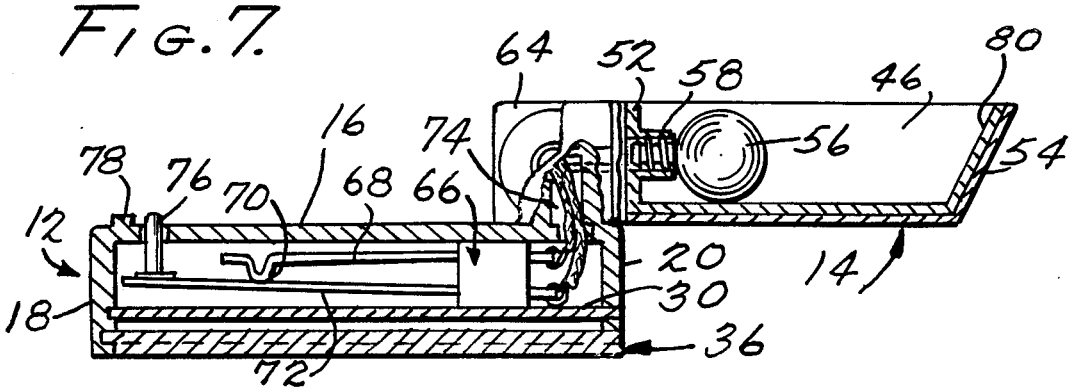
FIG. 7 is an enlarged cross-sectional view centrally through the fully opened portable light.

In the fully open position of the lamp housing, as illustrated in FIG. 7, the battery case 12 itself may be easily grasped within one hand, and the light used in the manner of a conventional area illuminating flashlight. At any intermediate open position, the portable light is particularly adapted for a variety of other purposes, for example use as a neck-suspended reading light. It is contemplated that the engagement of the extension 60 and lugs 62 thereon between the mounting posts 64 provide for a frictional retention of the lamp housing in any adjusted position.

The electrical circuit between the batteries 32 and the bulb 56 includes a switch 66 mounted within and to the rear of the switch compartment 26. The switch includes an upper forwardly elongate fixed position leaf contact 68 with a depending contact point 70 against which a lower flexibly resilient contact reed 72 normally engages. When so engaged, the circuit is closed and the bulb 56 illuminated. The actual wiring, as suggested in FIGS. 7 and 8, will extend from the switch 66 through a hollow passage 74 within one of the mounting posts 64 and through the hollow mounting lug 62 into the interior of the lamp housing extension 60 wherein appropriate contact is made with the bulb mounting components.

The lower contact reed 72 extends forwardly beyond the upper contact 68 and includes a vertically projecting rod or button 76 thereon which extends through and vertically beyond the face panel 16. The button 76 is positioned whereby upon a closing of the lamp housing 14, the leading edge thereof, that is the free edge of the front panel 54, will engage and depress the button 76 moving the lower contact reed 72 away from the contact projection 70 of the upper contact or contact leaf 68 thereby opening the circuit and shutting off the bulb 56. As will be recognized, the bulb will be illuminated in all pivotally adjusted positions of the lamp housing 14 other than for the fully closed position thereof. In this fully closed position, it will be appreciated that the bulb 56 is fully protected and the light compacted into a miniature configuration for easy storage within one's pocket or purse without danger of accidental damage to the bulb in particular.

As desired, an appropriate lip 78 can be provided on the upper surface of the face panel 16 immediately forward of the switch button 16 to snap-lock with the free edge of the forward panel 54 of the lamp housing 14 and thus act in the manner of a latch to provide a more positive retention of the lamp housing in the closed position thereof.

In order to achieve maximum illumination, notwithstanding the compact nature of the portable light, it will be noted that the lamp housing and the lamp compartment therein are substantially coextensive with the battery case. Also, it is contemplated that the lamp compartment 46 itself be provided with a coextensive illumination enhancing internal reflector 80.

Other advantages of the miniature portable light of the invention will be recognized.

I claim:

1. A portable light comprising a battery case, a lamp housing and means for mounting said lamp housing to said battery case for movement between a closed position and an open position, said battery case including a generally planar upper face panel and a back panel generally paralleling said face panel in spaced relation thereto, substantially continuous peripheral wall means between and joining said panels and defining a battery compartment therebetween, said lamp housing defining a bulb compartment with an open face, said lamp housing in the closed position overlying said upper face panel with the open face of said bulb compartment substantially engaged with and closed by said upper face panel of the battery case.

2. The portable light of claim 1 including means for forming an electrical circuit between said battery case and said lamp housing, and switch means responsive to movement of said lamp housing for opening said circuit in said closed position of said lamp housing and closing said circuit upon movement of said lamp housing from said closed position.

3. The portable light of claim 2 wherein said means for mounting said lamp housing to said battery case comprises a pivot mount fixed to and extending from said upper face panel, and complementary means on said lamp housing pivoting said lamp housing to said pivot mount whereby said movement of said lamp housing between said closed position and said open position is a pivotal movement.

4. The portable light of claim 3 wherein said pivotal movement is adjacent said peripheral wall, said lamp housing, in said open position, extending from said upper face panel at an angle to said upper face panel of up to approximately 180 degrees.

5. The portable light of claim 4 wherein said pivot mount comprises a pair of laterally spaced posts, said complementary means on said lamp housing including a projecting extension received between said posts, and projecting lugs and receiving sockets on said extension and posts retaining said extension between said posts for relative pivotal movement.

6. The portable light of claim 5 including passage means through at least one of said posts communicating with the interior of said extension for the accommodation of wiring as a component of said electrical circuit between said battery case and said lamp housing.

7. The portable light of claim 6 wherein said switch means includes a flexible reed biased into engagement with a complementary contact, and a push button on said reed extending through the face panel of the battery case and positioned for engagement and depression by said lamp housing in the closed position of said lamp housing for deflecting said reed away from said contact and opening said circuit.

8. The portable light of claim 1 wherein said means for mounting said lamp housing to said battery case comprises a pivot mount fixed to and extending from said upper face panel, and complementary means on said lamp housing pivoting said lamp housing to said pivot mount whereby said movement of said lamp housing between said closed position and said open position is a pivotal movement.

9. The portable light of claim 8 wherein said pivotal movement is adjacent said peripheral wall, said lamp housing, in said open position, extending from said upper face panel at an angle to said upper face panel of up to approximately 180 degrees.

10. The portable light of claim 9 wherein said lamp housing, in the closed position thereof, is completely within the peripheral confines of the battery case in overlying parallel relation thereto.

* * * * *